US012235037B2

(12) United States Patent
Krishna et al.

(10) Patent No.: US 12,235,037 B2
(45) Date of Patent: Feb. 25, 2025

(54) REFRIGERATION UNIT DOOR BRACKET

(71) Applicant: Whirlpool Corporation, Benton Harbor, MI (US)

(72) Inventors: Sai B. Krishna, Bangalore (IN); Sanket Phalak, Pune (IN); Aaron M. Stewart, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/060,054

(22) Filed: Nov. 30, 2022

(65) Prior Publication Data

US 2024/0175624 A1 May 30, 2024

(51) Int. Cl.
*F25D 23/02* (2006.01)

(52) U.S. Cl.
CPC ..... *F25D 23/028* (2013.01); *F25D 2323/024* (2013.01)

(58) Field of Classification Search
CPC .. F25D 2323/024; F25D 23/02; F25D 23/028; F25D 23/10; E05Y 2600/628; E05Y 2600/60; E05Y 2900/31; E05Y 2600/56; E05Y 2600/626; E05Y 2800/682; E05D 5/06

See application file for complete search history.

(56) References Cited

U.S. PATENT DOCUMENTS

| | | | | |
|---|---|---|---|---|
| 4,151,681 | A * | 5/1979 | Roberts | F25D 23/028 49/501 |
| 4,932,729 | A * | 6/1990 | Thompson | E05D 7/081 312/405 |
| 6,192,630 | B1 * | 2/2001 | Banicevic | F25D 23/02 49/501 |
| 6,209,265 | B1 * | 4/2001 | Banicevic | F25D 23/028 49/501 |
| 6,505,442 | B2 * | 1/2003 | Banicevic | F25D 23/02 52/657 |
| 6,926,379 | B1 * | 8/2005 | Grace | F25D 23/028 312/401 |
| 6,935,712 | B2 | 8/2005 | Reed et al. | |
| 7,014,283 | B2 | 3/2006 | Grace et al. | |
| 7,194,792 | B2 | 3/2007 | Grace et al. | |
| 10,724,790 | B2 | 7/2020 | Seo | |
| 2002/0190617 | A1 | 12/2002 | Banicevic et al. | |
| 2004/0012315 | A1 * | 1/2004 | Grace | F25D 23/062 312/406 |

(Continued)

FOREIGN PATENT DOCUMENTS

| | | | | |
|---|---|---|---|---|
| CN | 1664479 | A * | 9/2005 | E05D 5/065 |
| CN | 102242588 | B | 7/2015 | |

(Continued)

*Primary Examiner* — Hiwot E Tefera
(74) *Attorney, Agent, or Firm* — Price Heneveld LLP

(57) ABSTRACT

A refrigeration unit includes a cabinet that defines a storage cavity, a door pivotably coupled to the cabinet via a hinge and configured to selectively cover an opening to the storage cavity, and a bracket that connects the door to the hinge. The door includes a first surface, a second surface adjacent to the first surface, and a third surface adjacent to the first and second surfaces. The bracket includes a first portion fixed to the first surface, a second portion fixed to the second surface, and a third portion fixed to the third surface.

11 Claims, 5 Drawing Sheets

(56) References Cited

U.S. PATENT DOCUMENTS

| | | | | |
|---|---|---|---|---|
| 2008/0174218 | A1* | 7/2008 | Leimkuehler | F25D 23/02 312/405 |
| 2008/0180011 | A1 | 7/2008 | Leimkuehler et al. | |
| 2014/0208657 | A1* | 7/2014 | Kim | F25D 23/02 49/460 |
| 2019/0003224 | A1* | 1/2019 | Reuter | F25D 23/028 |
| 2019/0308393 | A1* | 10/2019 | Allard | B32B 15/00 |
| 2020/0408015 | A1* | 12/2020 | Manara | E05D 11/105 |
| 2023/0114849 | A1* | 4/2023 | Hunter | F25D 23/028 49/381 |

FOREIGN PATENT DOCUMENTS

| | | | | | |
|---|---|---|---|---|---|
| CN | 108244853 | A | | 7/2018 | |
| DE | 102012012312 | A1 | * | 11/2013 | F25D 23/02 |
| DE | 102019113461 | A1 | * | 10/2020 | F25D 23/028 |
| EP | 3153800 | A1 | | 4/2017 | |
| EP | 3757321 | A1 | * | 12/2020 | A21B 3/02 |
| KR | 900002341 | Y1 | * | 3/1990 | |
| KR | 19980086232 | A | * | 12/1998 | |
| KR | 200190483 | Y1 | * | 8/2000 | |
| KR | 200197565 | Y1 | | 10/2000 | |
| KR | 200217771 | Y1 | | 4/2001 | |
| KR | 200330478 | Y1 | | 12/2003 | |
| KR | 200396489 | Y1 | * | 9/2005 | |
| KR | 20050112670 | A | | 12/2005 | |

* cited by examiner

REFRIGERATION UNIT DOOR BRACKET

BACKGROUND OF THE DISCLOSURE

The present disclosure generally relates to a refrigeration unit. More specifically, the present disclosure relates to a bracket that is coupled to a door of a refrigeration unit and configured to be coupled with a hinge that pivotably connects the door and a cabinet of the refrigeration unit.

SUMMARY OF THE DISCLOSURE

According to one aspect of the present disclosure, a refrigeration unit includes a cabinet that defines a storage cavity, a door pivotably coupled to the cabinet via a hinge and configured to selectively cover an opening to the storage cavity, and a bracket that connects the door to the hinge. The door includes a first surface, a second surface adjacent to the first surface, and a third surface adjacent to the first and second surfaces. The bracket includes a first portion fixed to the first surface, a second portion fixed to the second surface, and a third portion fixed to the third surface.

According to another aspect of the present disclosure, a bracket for a refrigeration unit includes a first portion that defines an aperture, a second portion coupled to the first portion at a first bracket corner, and a tab that extends vertically outward from the first portion. Further, the aperture is vertically aligned with a portion of the tab.

According to yet another aspect of the present disclosure, a refrigeration unit includes a cabinet that defines a storage cavity, a door pivotably coupled to the cabinet via a hinge and configured to selectively cover an opening to the storage cavity, and a bracket that connects the door to the hinge. The door includes a first surface and a second surface adjacent to the first surface. The bracket includes a first portion fixed to the first surface and a second portion fixed to the second surface.

These and other features, advantages, and objects of the present disclosure will be further understood and appreciated by those skilled in the art by reference to the following specification, claims, and appended drawings.

Figure 1:
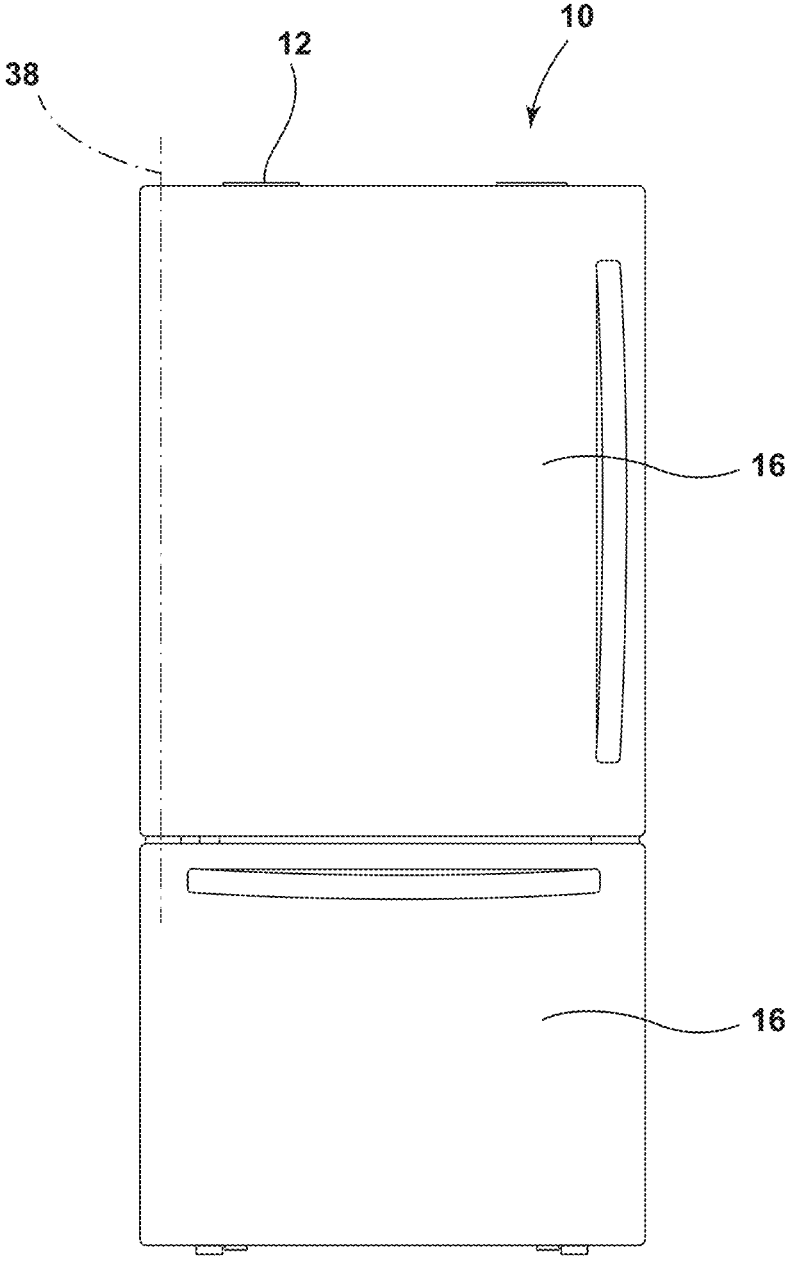
FIG. 1 is a front elevational view of a refrigeration unit of the present disclosure that includes a door in a closed position.

The components in the figures are not necessarily to scale, emphasis instead being placed upon illustrating the principles described herein.

DETAILED DESCRIPTION

The present illustrated embodiments reside primarily in apparatus components related to a door bracket for a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that an article or apparatus that comprises a list of elements does not include only those elements but may include other elements not expressly listed or inherent to such article or apparatus. An element preceded by "comprises a . . . " does not, without more constraints, preclude the existence of additional identical elements in the article or apparatus that comprises the element.

Referring to FIGS. 1-5, reference 10 generally designates a refrigeration unit. The refrigeration unit 10 includes a cabinet 12 that defines a storage cavity 14. A door 16 is pivotably coupled to the cabinet 12 via a hinge 18 and is configured to selectively cover an opening 20 to the storage cavity 14 defined by the cabinet 12. The door 16 includes a first surface 22, a second surface 24 that is adjacent to the first surface 22, and a third surface 26 that is adjacent to the first surface 22 and the second surface 24. A bracket 28 connects the door 16 to the hinge 18. The bracket 28 includes a first portion 30 that is fixed to the first surface 22 of the door 16, a second portion 32 that is fixed to the second surface 24 of the door 16, and a third portion 34 that is fixed to the third surface 26 of the door 16.

Figure 2:
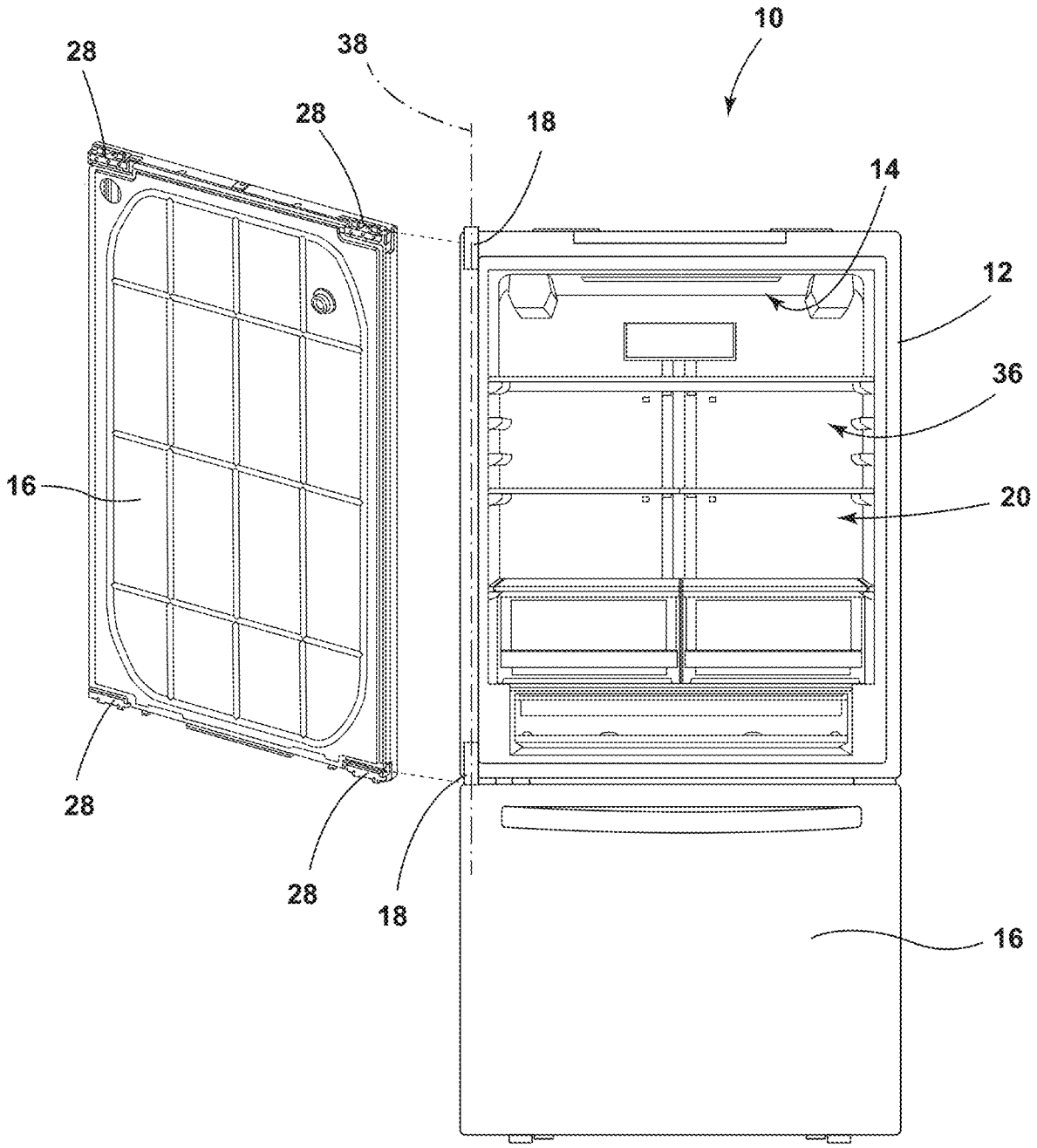
FIG. 2 is a front elevational view of a refrigeration unit of the present disclosure that includes a door that is configured to be coupled to the cabinet.

Referring now to FIGS. 1 and 2, the refrigeration unit 10 is illustrated. The refrigeration unit 10 includes the cabinet 12. As illustrated in FIG. 2, the cabinet 12 can define the storage cavity 14. The storage cavity 14 is configured to receive perishable items therein for refrigeration. In some implementations, the cabinet 12 can define a plurality of storage cavities 14. For example, the cabinet 12 can define a first storage cavity 14, such as the refrigeration compartment illustrated in FIG. 2, and a second storage cavity, such as a freezer compartment (not shown).

Referring still to FIGS. 1 and 2, the refrigeration unit 10 includes the door 16. The door 16 of the refrigeration unit 10 can be pivotably coupled to the cabinet 12 via the hinge 18. As illustrated in FIG. 2, the door 16 can be pivotably coupled to the cabinet 12 via a plurality of hinges 18. In the illustrated embodiment, two hinges 18 are configured to pivotably couple the door 16 to the cabinet 12 of the refrigeration unit 10, such that the door 16 is operable to pivot between an open position, wherein access to the storage cavity 14 is provided, and a closed position, wherein the door 16 covers an opening 20 to the storage cavity 14 (FIG. 1), about a pivot axis 38. As illustrated in FIGS. 1 and 2, the pivot axis 38 about which the door 16 pivots between the open and closed positions is a vertical pivot axis 38. As illustrated in FIGS. 1 and 2, the refrigeration unit 10 includes a plurality of doors 16. In particular, FIG. 2 illustrates a first door 16 that is configured to cover an opening 20 to the first storage cavity 14, and a second door 16 that is illustrated covering the opening 20 to a second storage cavity 14 (not shown).

Figure 4:
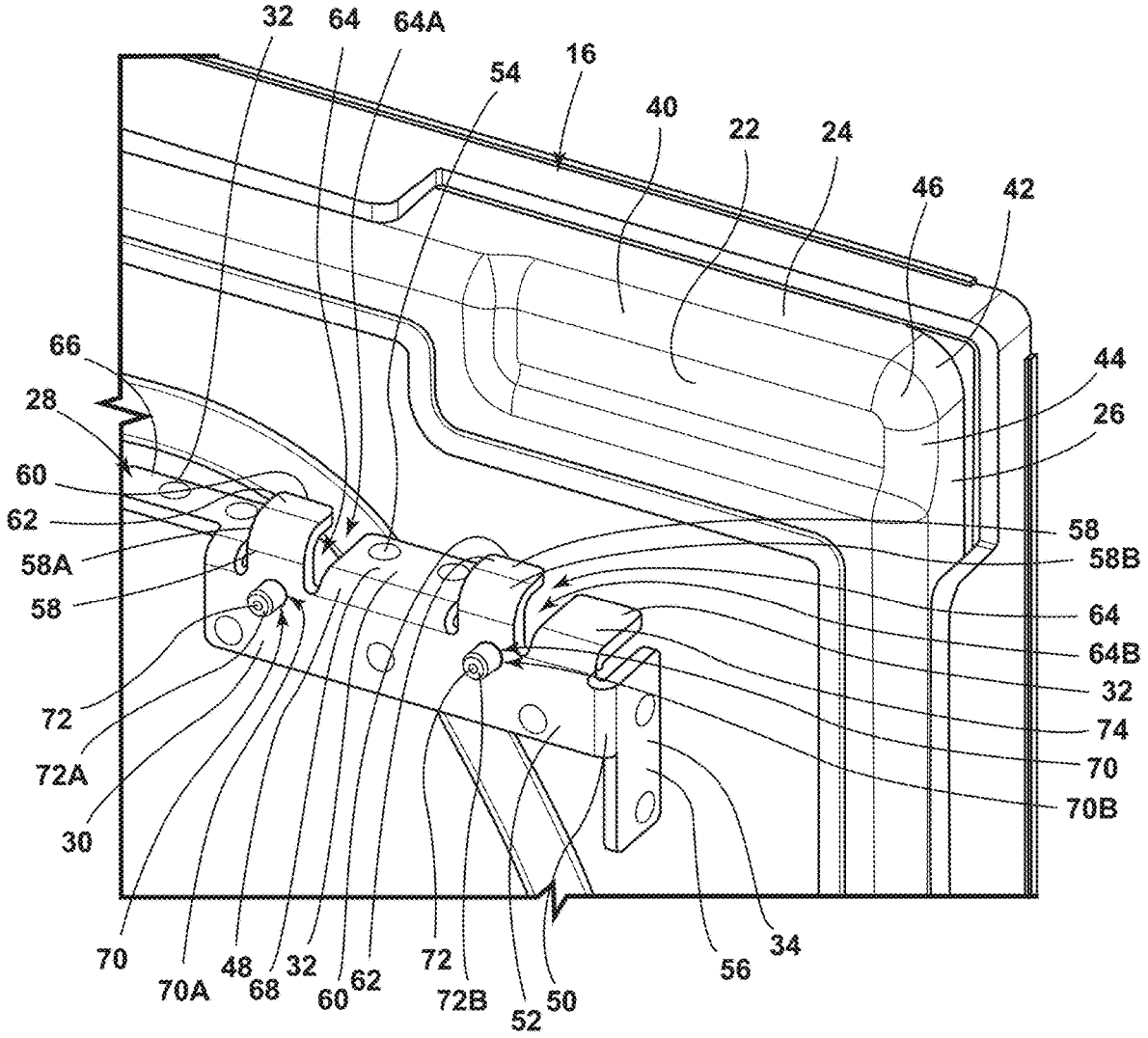
FIG. 4 is a top perspective view of a portion of a door of a refrigeration unit of the present disclosure and a bracket that is configured to be fixed to the door.

Referring now to FIGS. 1, 2, and 4, the door 16 of the refrigeration unit 10 can include the first surface 22, and the second surface 24 that is adjacent to the first surface 22, as illustrated in FIG. 4. In various implementations, in the closed position of the door 16, the first surface 22 faces substantially rearward. Further, the second surface 24 faces a substantially vertical direction. In the embodiment illustrated in FIG. 4, the second surface 24 faces upward and is substantially perpendicular to the first surface 22 which meets the second surface 24 at a first horizontally-extending corner 40. In various embodiments, a line that is normal to the second surface 24 extends vertically. In the embodiment illustrated in FIG. 4, the first horizontally-extending corner 40 is rounded. An unrounded first horizontally-extending corner 40 is also contemplated.

Referring still to FIGS. 1, 2, and 4, the door 16 can include the third surface 26 that is adjacent to the first surface 22 and the second surface 24. As illustrated in FIG. 4, the third surface 26 is substantially perpendicular to both the first surface 22 and the second surface 24. The third surface 26 and the second surface 24 converge at a second horizontally-extending corner 42, and the first surface 22 and the third surface 26 converge at a vertically-extending corner 44. In the embodiment illustrated in FIG. 4, the first and second horizontally-extending corners 40, 42, and the vertically-extending corner 44 are rounded corners. Unrounded corners are also contemplated. The first, second, and third surfaces 22, 24, 26 all converge together at an outside corner 46 where the first and second horizontally-extending corners 40, 42 and the vertically-extending corner 44 of the door 16 meet. As described further herein, the first, second, and/or third surfaces 22, 24, 26 of the door 16 may be configured to have the bracket 28 fixedly coupled thereto.

Figure 3:
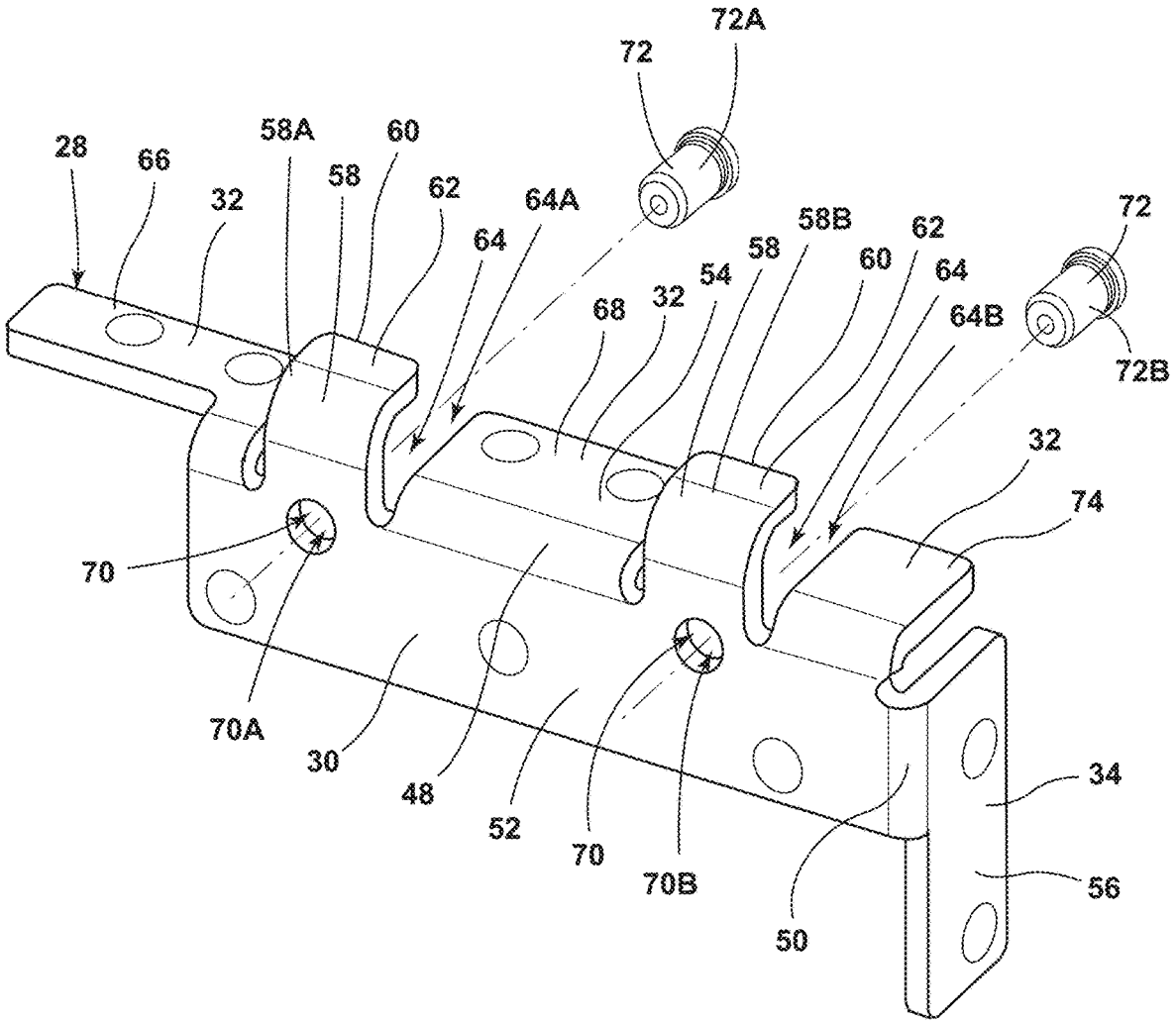
FIG. 3 is a top perspective view of a bracket and fasteners that are configured to be received within an aperture that is defined by the bracket.
Figure 5:
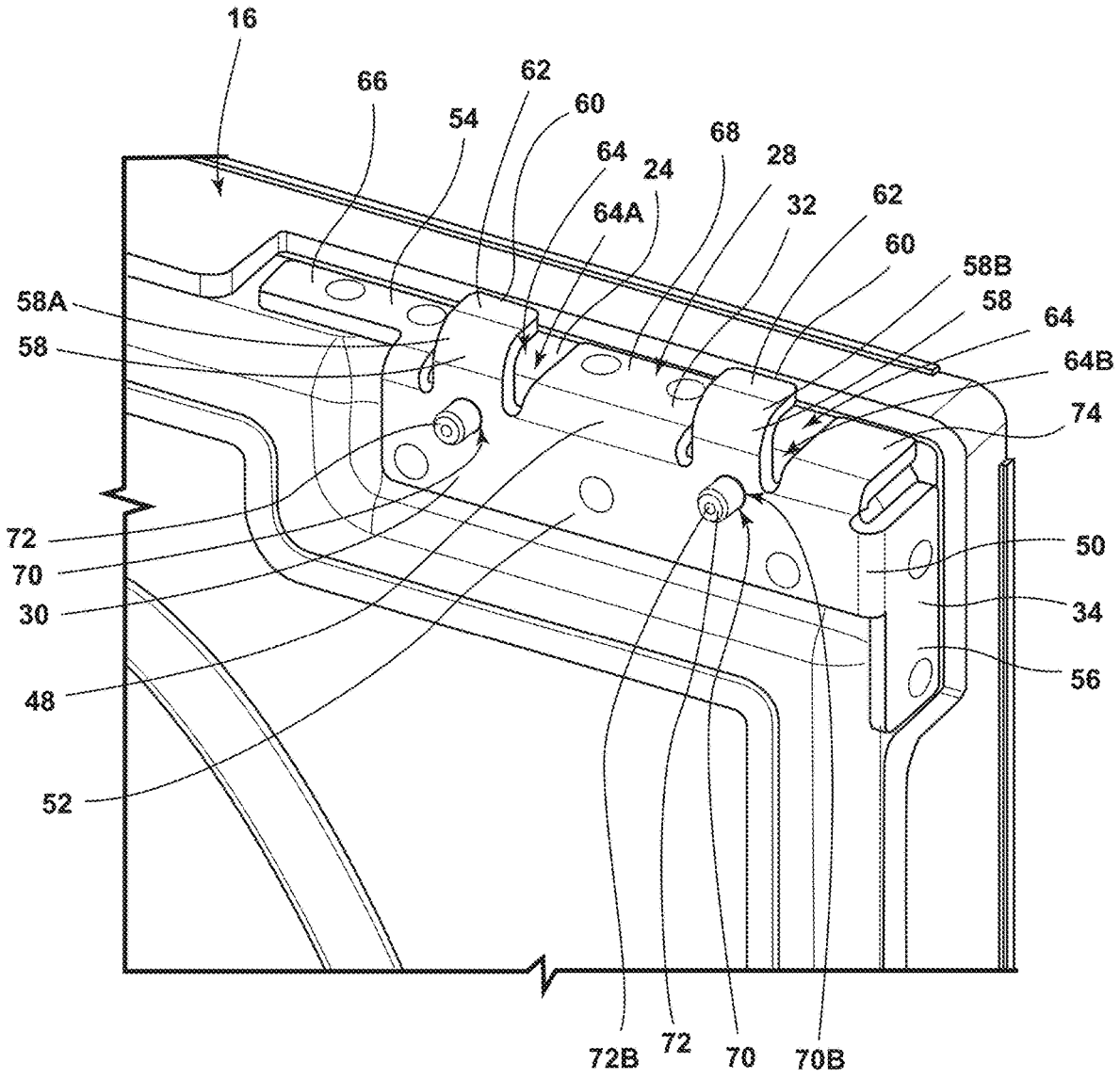
FIG. 5 is a top perspective view of a door of a refrigeration unit of the present disclosure and a bracket fixedly coupled to the door.

Referring now to FIGS. 2-5, the refrigeration unit 10 includes the bracket 28. The bracket 28 can include the first portion 30 and the second portion 32. In various implementations, the second portion 32 of the bracket 28 is coupled to the first portion 30 of the bracket 28 at a first bracket corner 48. In some implementations, the bracket 28 can include the third portion 34. As illustrated in FIG. 3, the third portion 34 is coupled to the first portion 30 at a second bracket corner 50. The bracket 28 is configured to be fixed to the door 16 of the refrigeration unit 10, as illustrated in FIG. 5. In the illustrated embodiment, the first, second, and third portions 30, 32, 34 include respective outer surfaces 52, 54, 56 that are opposite of the surfaces of the first, second, and third portions 30, 32, 34 that are fixed to the door 16 of the refrigeration unit 10. In some implementations, the outer surface 52 of the first portion 30 of the bracket 28 is perpendicular to the outer surface 54 of the second portion 32 of the bracket 28. In the embodiment illustrated in FIG. 3, the outer surface 56 of the third portion 34 of the bracket 28 is perpendicular to the outer surface 52 of the first portion 30 and the outer surface 54 of the second portion 32 of the bracket 28. Further, the outer surface 54 of the second portion 32 is perpendicular to the outer surface 52 of the first portion 30.

Referring now to FIGS. 3-5, the bracket 28 can include a tab 58 that extends vertically outward from the first portion 30. In the embodiment illustrated in FIG. 3, the second portion 32 of the bracket 28 is vertically offset from the first portion 30. As illustrated, the tab 58 extends vertically outward from the first portion 30, such that at least a portion of the tab 58 is vertically offset from the first portion 30 further than the vertically-offset-most portion of the second portion 32 of the bracket 28. In the embodiment illustrated in FIG. 3, the tab 58 extends upward from the first portion 30 to a distal end 60. The distal end 60 is positioned upward of the second portion 32. In other words, the distal end 60 is elevated relative to the second portion 32 of the bracket 28.

Referring still to FIGS. 3-5, in some implementations, the tab 58 can include a tang 62. For example, as illustrated in FIG. 3, the tab 58 extends vertically upward from the first portion 30 and then hooks outward toward the distal end 60 of the tab 58 to form the tang 62. In the illustrated embodiment, the tang 62 extends horizontally outward in a direction that is generally parallel to the direction that the second portion 32 of the bracket 28 extends horizontally outward from the first bracket corner 48. As illustrated in FIGS. 3-5, the tang 62 is vertically offset from the second portion 32 of the bracket 28.

Referring still to FIGS. 3-5, the second portion 32 of the bracket 28 can define a gap 64 that generally corresponds with the tab 58 that extends vertically outward from the first portion 30 of the bracket 28. In the embodiment illustrated in FIG. 3, the second portion 32 of the bracket 28 includes a first panel 66 and a second panel 68 that is spaced apart from the first panel 66 by the gap 64 that is defined between the first and second panels 66, 68 of the second portion 32. As illustrated in FIG. 3, the tab 58 extends outward from a portion of the first portion 30 that is between the first and second panels 66, 68 of the second portion 32. The tang 62 of the tab 58 illustrated in FIG. 3 extends over the gap 64 that is defined between the first and second panels 66, 68 of the second portion 32. As such, the gap 64 defined by the second portion 32 of the bracket 28 vertically aligns with the tang 62 of the tab 58. In other words, a vertical axis that intersects the tang 62 intersects the gap 64.

Referring now to FIGS. 3-5, the first portion 30 of the bracket 28 can define an aperture 70. The aperture 70 is configured to receive a fastener 72 for coupling the bracket 28 with the hinge 18 of the refrigeration unit 10. In some implementations, the aperture 70 defined by the first portion 30 of the bracket 28 is positioned relative to the tab 58 that extends vertically outward from the first portion 30, such that the aperture 70 is vertically aligned with a portion of the tab 58. In other words, a vertical axis that intersects the aperture 70 intersects a portion of the tab 58 As illustrated in FIGS. 3-5, the aperture 70 is generally aligned with both the tab 58 and the gap 64 defined by the second portion 32. The gap 64 in the second portion 32 and the tab 58 being vertically offset from the second portion 32 may allow for convenient insertion of the fastener 72 into the aperture 70 that is defined by the first portion 30 of the bracket 28 and aligned with the gap 64 and the tab 58.

In some implementations, the bracket 28 can include a plurality of tabs 58, including a first tab 58A and a second tab 58B, gaps 64, including a first gap 64A and a second gap 64B, and apertures 70, including a first aperture 70A and a second aperture 70B. For example, in the embodiment illustrated in FIG. 3, the first tab 58A extends upward from the first portion 30, the second tab 58B extends upward from the first portion 30, the second portion 32 of the bracket 28 defines the first gap 64A that is generally aligned with the first tab 58A between the first and second panels 66, 68 of the second portion 32, the second gap 64B that is generally aligned with the second tab 58B between the second panel 68 and a third panel 74 of the second portion 32, the first aperture 70A that is vertically aligned with a portion of the first tab 58A, and the second aperture 70B that is vertically aligned with a portion of the second tab 58B. It is contemplated that the bracket 28 can include a variety of numbers of tabs 58, gaps 64, and apertures 70, in various embodiments.

Referring now to FIGS. 2-5, the bracket 28 is configured to be coupled with the door 16 of the refrigeration unit 10. In various embodiments, the first portion 30 of the bracket 28 is configured to be fixed to the first surface 22 of the door 16, and the second portion 32 of the bracket 28 is configured to be fixed to the second surface 24 of the door 16. In the embodiment illustrated in FIG. 5, the first portion 30 of the bracket 28 is fixed to the first surface 22 of the door 16, the second portion 32 of the bracket 28 is fixed to the second surface 24 of the door 16, and the third portion 34 of the bracket 28 is fixed to the third surface 26 of the door 16. It is contemplated that the bracket 28 may be fixed to the door 16 in a variety of ways (e.g., fasteners, adhesives, etc.). In some implementations, the first portion 30 of the bracket 28 can be welded to the first surface 22 of the door 16, the second portion 32 of the bracket 28 can be welded to the second surface 24 of the door 16, and/or the third portion 34 of the bracket 28 can be welded to the third surface 26 of the door 16. For example, in the embodiment illustrated in FIG. 5, the first, second, and third portions 30, 32, 34 of the bracket 28 are welded to the first, second, and third surfaces 22, 24, 26 of the door 16, respectively.

As illustrated in FIG. 5, the second portion 32 of the bracket 28 is positioned upward of the second surface 24. The tang 62 of the tab 58 that extends upward from the first portion 30 of the bracket 28 extends over the second surface 24 of the door 16. The gap 64 defined by the second portion 32 of the bracket 28 vertically aligning with the tang 62 of the tab 58 results in the tang 62 being positioned directly above the second surface 24, in the embodiment illustrated in FIG. 5, unimpeded by the second portion 32 of the bracket 28.

The refrigeration unit 10 of the present disclosure may provide a variety of advantages. First, the bracket 28 having first, second, and third portions 30, 32, 34 that are fixed to first, second, and third surfaces 22, 24, 26 of the door 16 of the refrigeration unit 10, respectively, ensures the rigidity and structural integrity of the connection of the bracket 28 and the door 16. Second, the gap 64 and the tab 58 being aligned with the aperture 70 defined by the first portion 30 of the bracket 28 can allow for convenient insertion of the fastener 72 into the aperture 70 through an opening of the aperture 70 that is defined by the surface of the first portion 30 opposite the outer surface 52 of the first portion 30.

According to an aspect of the present disclosure, a refrigeration unit includes a cabinet that defines a storage cavity, a door pivotably coupled to the cabinet via a hinge and configured to selectively cover an opening to the storage cavity, and a bracket that connects the door to the hinge. The door includes a first surface, a second surface adjacent to the first surface, and a third surface adjacent to the first and second surfaces. The bracket includes a first portion fixed to the first surface, a second portion fixed to the second surface, and a third portion fixed to the third surface.

According to another aspect, the first portion is welded to the first surface.

According to another aspect, the second portion is welded to the second surface.

According to another aspect, the third portion is welded to the third surface.

According to another aspect, the second portion is positioned upward of the first portion.

According to another aspect, the bracket further includes a tab that extends upward from the first portion to a distal end that is positioned upward of the second portion.

According to another aspect, the tab includes a tang that extends over the second surface of the door.

According to another aspect, the second portion of the bracket defines a gap that vertically aligns with the tang that extends over the second surface of the door.

According to another aspect, the first portion of the bracket defines an aperture configured to receive a fastener for coupling the bracket with the hinge, wherein the aperture is positioned relative to the tab, such that a vertical axis that intersects the aperture intersects a portion of the tab.

According to another aspect, a line that is normal to the second surface extends vertically.

According to another aspect of the present disclosure, a bracket for a refrigeration unit includes a first portion that defines an aperture, a second portion coupled to the first portion at a first bracket corner, and a tab that extends vertically outward from the first portion. Further, the aperture is vertically aligned with a portion of the tab.

According to another aspect, the second portion includes a first panel and a second panel spaced apart from the first panel by a gap that is defined between the first and second panels.

According to another aspect, the tab includes a tang that extends over the gap defined between the first and second panels.

According to another aspect, the bracket further includes a third portion coupled to the first portion at a second bracket corner, wherein an outer surface of the third portion is perpendicular to an outer surface of the first portion and an outer surface of the second portion, and the outer surface of the second portion is perpendicular to the outer surface of the first portion.

According to yet another aspect of the present disclosure, a refrigeration unit includes a cabinet that defines a storage cavity, a door pivotably coupled to the cabinet via a hinge and configured to selectively cover an opening to the storage cavity, and a bracket that connects the door to the hinge. The door includes a first surface and a second surface adjacent to the first surface. The bracket includes a first portion fixed to the first surface and a second portion fixed to the second surface.

According to another aspect, the first and second portions are welded to the first and second surfaces, respectively.

According to another aspect, the bracket further includes a tab that extends vertically outward from the first portion.

According to another aspect, the first portion defines an aperture that is vertically aligned with a portion of the tab.

According to another aspect, the tab extends from the first portion to a distal end that is vertically offset from the first portion further than the second portion is vertically offset from the first portion.

According to yet another aspect, the bracket further includes a third portion that is fixed to a third surface of the door that is adjacent to the first surface and the second surface.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

What is claimed is:

1. A refrigeration unit, comprising:
- a cabinet that defines a storage cavity;
- a door pivotably coupled to the cabinet via a hinge and configured to selectively cover an opening to the storage cavity, the door comprising:
  - a first surface;
  - a second surface adjacent to the first surface; and
  - a third surface adjacent to the first and second surfaces; and
- a bracket that connects the door to the hinge, the bracket comprising:
  - a first portion fixed to the first surface;
  - a second portion fixed to the second surface and positioned upward of the first portion;
  - a third portion fixed to the third surface; and
  - a tab that extends upward from the first portion to a distal end that is positioned upward of the second portion, wherein the first portion of the bracket defines an aperture configured to receive a fastener for coupling the bracket with the hinge, and wherein the aperture is positioned relative to the tab, such that a vertical axis that intersects the aperture intersects a portion of the tab.

2. The refrigeration unit of claim 1, wherein the first portion is welded to the first surface.

3. The refrigeration unit of claim 2, wherein the second portion is welded to the second surface.

4. The refrigeration unit of claim 3, wherein the third portion is welded to the third surface.

5. The refrigeration unit of claim 1, wherein the tab includes a tang that extends over the second surface of the door.

6. The refrigeration unit of claim 5, wherein the second portion of the bracket defines a gap that vertically aligns with the tang that extends over the second surface of the door.

7. The refrigeration unit of claim 1, wherein a line that is normal to the second surface extends vertically.

8. A refrigeration unit, comprising:
- a cabinet that defines a storage cavity;
- a door pivotably coupled to the cabinet via a hinge and configured to selectively cover an opening to the storage cavity, the door comprising:
  - a first surface;
  - a second surface adjacent to the first surface; and
  - a third surface adjacent to the first and second surfaces, wherein the first, second, and third surfaces converge at an outside corner; and
- a bracket that connects the door to the hinge, the bracket comprising:
  - a first portion fixed to the first surface of the door;
  - a second portion fixed to the second surface of the door; and
  - a third portion fixed to the third surface of the door; wherein the first and second portions are welded to the first and second surfaces, respectively.

9. The refrigeration unit of claim 8, wherein the bracket further comprises:
- a tab that extends vertically outward from the first portion.

10. The refrigeration unit of claim 9, wherein the first portion defines an aperture that is vertically aligned with a portion of the tab.

11. The refrigeration unit of claim 9, wherein the tab extends from the first portion to a distal end that is vertically offset from the first portion further than the second portion is vertically offset from the first portion.

* * * * *